United States Patent [19]

Bastijanic et al.

[11] Patent Number: 4,975,067

[45] Date of Patent: Dec. 4, 1990

[54] SURFACE CONTACT POWER CONNECTOR

[75] Inventors: Edward Bastijanic, Concord; Timothy B. McGlinchy, Wickliffe; Gary S. Thomas, Eastlake; David J. Wroblewski, Mentor, all of Ohio

[73] Assignee: Elsag International B.V., Amsterdam, Netherlands

[21] Appl. No.: 413,513

[22] Filed: Sep. 27, 1989

[51] Int. Cl.[5] ..... H01R 23/70

[52] U.S. Cl. ..... 439/65; 439/79; 439/924

[58] Field of Search ..... 439/79, 80, 83, 629, 439/924, 65, 66, 74

[56] References Cited

U.S. PATENT DOCUMENTS

| | | | |
|---|---|---|---|
| 3,101,231 | 8/1963 | Klostermann | 439/676 |
| 4,050,769 | 9/1977 | Ammon | 439/80 |
| 4,516,188 | 5/1985 | Kessler | 361/408 |
| 4,695,106 | 9/1987 | Feldman et al. | 439/874 |
| 4,738,625 | 4/1988 | Burton et al. | 439/59 |

*Primary Examiner*—Neil Abrams

*Attorney, Agent, or Firm*—Vytas R. Matas; Robert J. Edwards; Daniel S. Kalka

[57] ABSTRACT

A connector for a power module to selectively engage metallic pads positioned on the backplate printed circuit board is disclosed. The connector includes a first set of contacts and a second set of contacts positioned such that the first set of contacts makes engagement with the metallic pads before the second set of contacts make such engagement. The contacts are capable of carrying relatively high current.

5 Claims, 2 Drawing Sheets

SURFACE CONTACT POWER CONNECTOR

TECHNICAL FIELD

The present invention relates, in general, to a power connecting device and, more particularly, to a connector that interconnects a power module to a backplane printed circuit board by making surface contact therewith.

BACKGROUND ART

Power connectors presently available typically consist of two parts, a male portion and a female portion, both of which are necessary to make an electrical connection. These connectors are quite expensive when multiple mating connectors must be dedicated, such as in a power system where a connection is desired in only one or two slots at a time. In order to be able to plug a card into any slot requires a dedicated mating connector in every slot on the backplane printed circuit board or a wire to wire type connector. Previously, power connectors have been available with a 6 to 8 amp contact rating which is not sufficient for some modular power system requirements. If more than 8 amps of current might pass through a contact, multiple contacts connected in parallel must be used which can prove to be unreliable if one of the contacts fails, forcing the remaining contact to carry more than 100% of its current rating.

Because of the foregoing, it has become desirable to develop a connection scheme that requires only one connector per module to interconnect the module with the backplane printed circuit board, and wherein some of the contacts can carry relatively high currents while the remaining contacts carry lower currents.

SUMMARY OF THE INVENTION

The present invention solves the problems associated with prior art connectors and other problems by providing a connection scheme that requires only one power connector per module to interconnect the module with the backplane printed circuit board. The power connector of the present invention includes a first set of contacts and a second set of contacts positioned within the connector such that the first set of contacts engages the backplane printed circuit board before the second set of contacts make such engagement. In this manner, secondary current connections can be made before primary circuit connections thus reducing "glitches" on the power bus of the system. Each contact is capable of carrying relatively high current thus eliminating the need of connecting contacts in parallel in order to carry the required current.

DESCRIPTION OF THE PREFERRED EMBODIMENT

Figure 1:
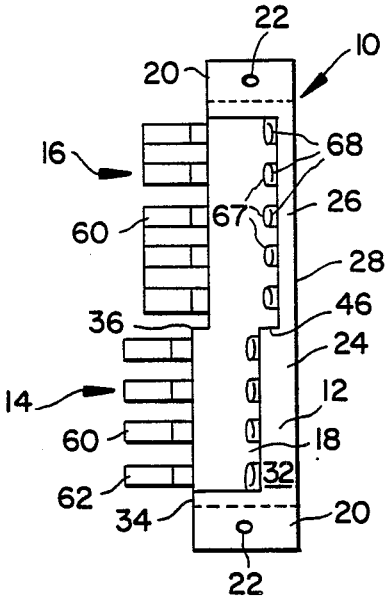
FIG. 1 is a bottom plan view of the power connector of the present invention.
Figure 2:
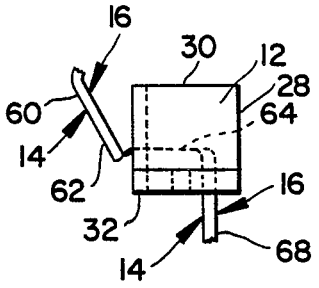
FIG. 2 is a front elevational view of the power connector illustrated in FIG. 1.

Referring now to the drawings where the illustrations are for the purpose of describing the preferred embodiment of the present invention and are not intended to limit the invention hereto, FIG. 1 is a bottom plan view of the power connector 10 of the present invention. The power connector 10 is comprised of a base member 12 which receives a first set of electrical contacts 14 and a second set of electrical contacts 16, and an insert 18 which retains the first set of contacts 14 and the second set of contacts 16 within the base member 12.

Figure 3:
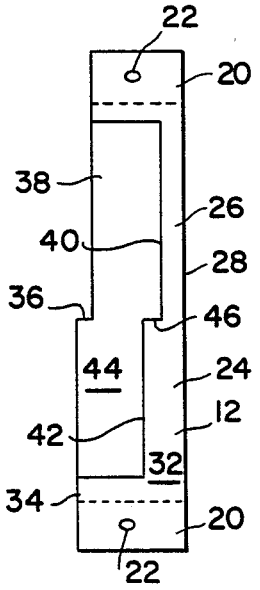
FIG. 3 is a bottom plan view of the base member of power connector illustrated in FIG. 1.

The base member 12 is formed from an insulating material, such as ceramic, and is substantially square in cross-section when the insert 18 is received therein. Ear members 20 are provided on opposite ends of the base member 12 and have an aperture 22 therein permitting the base member 12 to be mounted to the electrical power module (not shown) which the connector interconnects to the backplane printed circuit board, hereinafter described. The base member 12 includes a first portion 24 and a second portion 26, both substantially square in cross-section when insert 18 is received therein. The first and second portions 24 and 26 of the base member 12 have a common side 28, a common top 30 and a common bottom 32 when the insert 18 is received therein. The first portion 24 is slightly larger in cross-sectional area than the second portion 26 resulting in the remaining side 34 of the base member 12 having a step 36 at the junction of the first portion 24 and the second portion 26. A recess, shown generally by the numeral 38, is provided in the base member 12 and is positioned so as to intersect the bottom 32 and the remaining side 34 of the base member 12, as shown in FIG. 3. The recess 38 is of substantially equal cross-sectional area throughout the first portion 24 and the second portion 26 resulting in the formation of walls 40 and 42 substantially parallel to remaining side 34 and common side 28, and a surface 44 substantially parallel to bottom 32 and top 30 of the base member 12. Since first portion 24 is slightly larger in cross-sectional area than second portion 26 resulting in the formation of step 36 at their junction, a similar step 46 is formed at the junction of walls 40 and 42.

Figure 4:
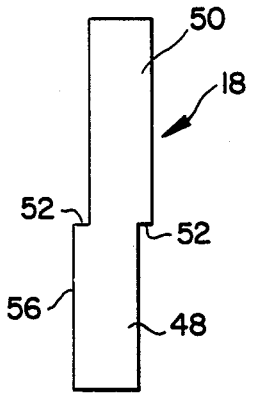
FIG. 4 is a bottom plan view of the insert which is received within the recess in the base member illustrated in FIG. 3.
Figure 5:
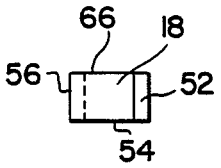
FIG. 5 is a front elevational view of the insert illustrated in FIG. 4.

Insert 18 is formed from an insulating material, such as ceramic, and is shaped so as to be complementary to and receivable in recess 38 in base member 12. As shown in FIG. 4, insert 18 includes a first portion 48 and a second portion 50, both having substantially the same cross-sectional area which approximates the cross-sectional area of recess 38 in base member 12 resulting in the formation of a step 52 at their junction and which coincides with steps 36 and 46 in base member 12 when the insert 18 is received therein. After insertion of the insert 18 into recess 38 in base member 12, the bottom 54 of insert 18 coincides with the bottom 32 of base member 12, and side 56 of the insert 18 coincides with side 34 of base member 12. Each electrical contact 60 includes a resilient, curved spring portion 62 which is positioned exterior to the base member 12 and the insert 18, a mounting portion 64 which is captured between surface 66 on insert 18 and surface 44 formed by recess 38 in the base member 12, and a connecting portion 68 exterior to the base member 12 and positioned adjacent its bottom 32. The mounting portion 64 of each contact 60 is shaped to form a substantially right angle and the resilient spring portion 62 is configured so that its end is substantially parallel to its connecting portion 68. A slot (67) may be provided in surface 66 on insert 18 or in surface 44 in base member 12 to receive each contact 60. The insert 18 is retained within the base member 12 by means of an adhesive.

Figure 6:
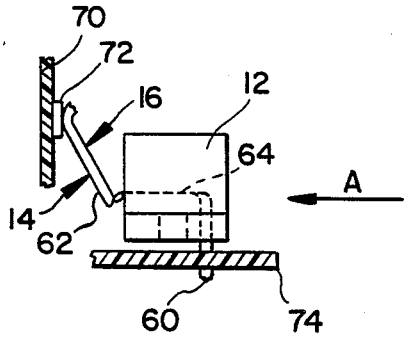
FIG. 6 is a front elevational view of the power connector illustrated in FIG. 1 and showing the engagement of its contacts with a backplane printed circuit board.

Since first portion 24 of the base member 12 is slightly larger in cross-sectional area than second portion 26 and inasmuch as recess 38 is substantially constant in cross-sectional area for its entire length, when the power connector 10 is assembled, the first set of contacts 14 adjacent the first portion 24 are positioned so as to make engagement with any parallel surface before the second set of contacts 16 make such engagement. Thus, when the power connector 10 is used to interconnect a power module (not shown) located on a circuit board 74 by mounting the connector 10 in the plug-in direction of arrow A with a backplane printed circuit board 70, as shown in FIG. 6, the first set of contacts 14 will engage the backplane printed circuit board before the second set of contacts 16 make such engagement. The backplane printed circuit board 70 is provided with a plurality of metallic pads 72 which are positioned adjacent the first and second set of contacts 14 and 16, respectively. When a power module (not shown) is inserted into the rack, the first set of contacts 14 make engagement with pads 72 before similar engagement is made by the second set of contacts 16. By connecting the secondary circuit connections to the first set of contacts 14 and the primary circuit connections to the second set of contacts 16, the secondary connections can be made prior to the primary connections, thus reducing "glitches" on the power bus of the system. In addition, since the resilient spring portion 62 of each contact 60 is curved, a wiping action occurs between this spring portion 62 and its associated pad 72 on the backplane printed circuit board 70 each time the contact engages and disengages the pad, thus "scrubbing" the pad. Lastly, besides providing for one set of contacts making engagement before another set of contacts makes such engagement, each contact can carry a different current. Thus, the power contactor 10 of the present invention permits the contacts to carry various currents, provides a wiping action between the contact and its associated pad upon engagement and disengagement, and allows one or more contacts to make engagement with the backplane printed circuit board before the remaining contacts make such engagement.

Certain modifications and improvements will occur to those skilled in the art upon reading the foregoing. It should be understood that all such modifications and improvements have been deleted herein for the sake of conciseness and readability, but are properly with the scope of the following claims.

We claim:

1. An electrical connector comprising a base member having a recess therein, said recess being substantially parallel to the longitudinal axis of the base member and including a first portion and a second portion, said first and second portions being oriented at a predetermined offset from axial alignment, a first set of electrical contacts positioned within said first portion of said recess and a second set of electrical contacts positioned within said second portion of said recess, said first set of electrical contacts being similarly offset as said first portion from axially alignment with and substantially parallel to said second set of electrical contacts within said second portion, and means for retaining said first set of electrical contacts and said second set of electrical contacts within said base member, said base member further being adapted to mount on and to electrically engage a circuit card, whereby said first set of electrical contacts as positioned within the electrical connector makes surface contact prior to said second set of electrical contacts.

2. The electrical connector as defined in claim 1 wherein said retaining means is an insert having a configuration substantially complementary to said recess in said base member, said insert being receivable within said recess in said base member to capture said first set of electrical contacts and said second set of electrical contacts between said insert and said base member.

3. The electrical connector as defined in claim 1 wherein each of said electrical contacts in said first set of electrical contacts and said second set of electrical contacts includes outside of said recess a connecting portion and a resilient contacting portion.

4. The electrical connector as defined in claim 3 wherein said connecting portion and said contacting portion of each said electrical contacts are substantially parallel.

5. The electrical connector as defined in claim 1 wherein said base member and said insert are formed from insulating material.

* * * * *